US007287529B2

(12) United States Patent
Mengoli et al.

(10) Patent No.: US 7,287,529 B2
(45) Date of Patent: Oct. 30, 2007

(54) CIGARETTE MAKER

(75) Inventors: Fausto Mengoli, Sasso Marconi (IT); Massimo Sartoni, Bologna (IT); Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 528 days.

(21) Appl. No.: 10/833,119

(22) Filed: Apr. 28, 2004

(65) Prior Publication Data

US 2004/0216752 A1 Nov. 4, 2004

(30) Foreign Application Priority Data

Apr. 29, 2003 (IT) ..... BO2003A0246

(51) Int. Cl.

| | |
|---|---|
| ***A24B 7/14*** | (2006.01) |
| ***A24B 1/02*** | (2006.01) |
| ***A24B 3/06*** | (2006.01) |
| ***A24C 1/02*** | (2006.01) |
| ***A24C 5/39*** | (2006.01) |

(52) U.S. Cl. ..... 131/109.2; 131/108; 131/27.1; 131/55; 131/56; 131/57

(58) Field of Classification Search ..... 131/108
See application file for complete search history.

(56) References Cited

U.S. PATENT DOCUMENTS

| | | | | |
|---|---|---|---|---|
| 4,524,781 | A * | 6/1985 | Seragnoli | 131/108 |
| 4,700,719 | A * | 10/1987 | Sheahan | 131/84.4 |
| 4,889,138 | A | 12/1989 | Heitmann | |
| 6,516,083 | B1 * | 2/2003 | Bonechi et al. | 382/141 |

* cited by examiner

*Primary Examiner*—Steven P. Griffin
*Assistant Examiner*—Phu Nguyen
(74) *Attorney, Agent, or Firm*—Timothy J. Klima

(57) ABSTRACT

In a cigarette maker comprising a descent channel filled with shredded tobacco by a carding unit and with reclaimed tobacco by a conveyor, the shredded tobacco and the reclaimed tobacco are taken up and transferred by a toothed unit toward an ascent channel, from where both are attracted onto a belt by suction and formed into a continuous stream; the descent channel is split into two distinct portions serving respectively to admit the shredded tobacco and the reclaimed tobacco, whilst the toothed unit comprises a first and a second roller positioned to take up the shredded tobacco and reclaimed tobacco and operating in conjunction with respective impeller rollers.

18 Claims, 2 Drawing Sheets

CIGARETTE MAKER

BACKGROUND OF THE INVENTION

The present invention relates to a cigarette maker.

The prior art embraces cigarette making machines comprising an infeed chamber from which shredded tobacco is taken up by a carding unit and directed into a descending channel.

At the bottom end of the descent channel, the tobacco is transferred by a toothed outfeed unit onto a feed conveyor and then carried by this same conveyor toward the bottom end of an ascending outfeed channel. The top end of the ascent channel is enclosed by a further conveyor consisting in an air-permeable, aspirating belt loop such as will attract the tobacco, rising through the ascent channel as a continuous flow of divided particles, and cause it to form gradually into a continuous stream of filler.

The stream of tobacco forming thus externally of the ascent channel is directed by the aspirating belt loop through a trimming station of which the function is to reduce the stream to a predetermined and uniform thickness.

The trimmed stream of tobacco is then released by the aspirating belt to the entry point of a station where it is formed into a continuous cigarette rod.

Generally speaking, the descent channel functions as a temporary storage facility or buffer, being occupied permanently by a column of tobacco, and is filled by a carding unit positioned to take up the shredded tobacco from a hopper.

Cigarette makers of the type thus outlined are fed not only with newly shredded tobacco, but also with reclaimed tobacco recovered from the trimming station and directed by a relative conveyor device back into the descent channel.

Having passed already through the carding unit, the ascent channel and the trimming station, then along the conveyor device, the reclaimed tobacco will naturally be dissimilar to the newly shredded tobacco in terms of both particle size and moisture content.

In addition, it is provenly difficult to achieve a uniform distribution of the reclaimed tobacco internally of the descent channel. Any such lack of uniform distribution brings notable drawbacks, in that it will result in an uneven composition of the tobacco filler along the continuous cigarette rod, and consequently in the single cigarettes cut from the continuous rod.

The object of the present invention is to provide a cigarette maker unaffected by the aforementioned drawbacks.

SUMMARY OF THE INVENTION

The stated object is realized according to the invention in a cigarette maker that comprises a descent channel, a carding unit by which shredded tobacco is fed into the descent channel, also conveyor means by which reclaimed tobacco is fed into the selfsame channel, a toothed unit by which the shredded tobacco and reclaimed tobacco are taken up and directed toward an ascent channel through which the tobacco is carried as a flow of distinct particles, and an aspirating belt placed at the outlet of the ascent channel, by which the flow of particles is formed into a continuous stream and advanced toward a trimming station, thence to the entry point of a station at which the stream is formed into a continuous cigarette rod.

To advantage, the descent channel presents a first portion and a second portion distinct one from the other and serving respectively to admit shredded tobacco and reclaimed tobacco, whilst the toothed unit comprises a first section and a second section by which the shredded tobacco and the reclaimed tobacco are taken up from the respective outlet ends of the first and second portions of the descent channel.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
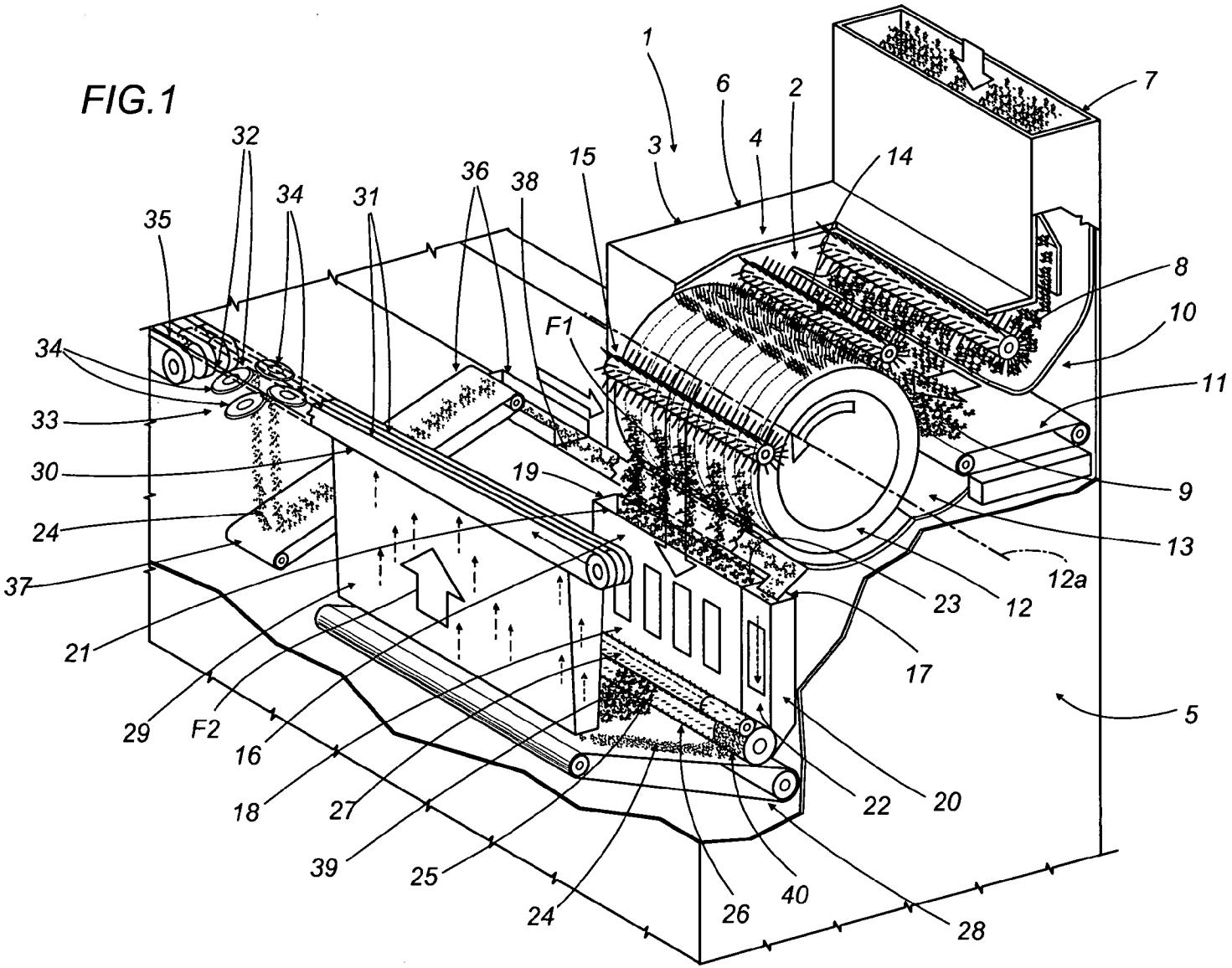
FIG. 1 illustrates a portion of a cigarette maker, viewed schematically in perspective and part cutaway, comprising a tobacco feed unit embodied in accordance with the present invention.

Referring to FIG. 1 of the drawings, 1 denotes the infeed portion of a cigarette maker, in its entirety, comprising a feed unit 2 by which a mass of shredded tobacco is formed into a continuous flow of tobacco particles. The components of the feed unit 2 are housed in a vertically extending enclosure 3 delimited uppermost by a horizontal wall 4 and on either side by two vertical walls 5 and 6.

The infeed portion 1 presents an inlet duct 7 extending upward from the horizontal wall 4, and below the duct, internally of the enclosure 3, a power driven toothed roller 8 by which the shredded tobacco 9 is directed down into a lower chamber 10 delimited at the bottom by a conveyor belt 11.

The chamber 10 accommodates a carding roller 12 rotatable about an axis 12*a* transverse to the side walls 5 and 6, forming part of a carding unit 13 and positioned adjacent to the downstream end of the belt 11. In addition to the carding roller 12, the unit 13 comprises a proportioning roller 14 rotatable substantially tangential to the carding roller 12 and in the same direction.

With this arrangement, the shredded tobacco 9 is directed by the toothed roller 8 onto the belt 11 and then toward the carding roller 12, whereupon a layer of the shredded tobacco 9 substantially equal in thickness to the radial dimension of the carding teeth is transferred by the roller 12 away from the chamber 10 and beyond its position tangential to the proportioning roller 14.

The infeed portion further comprises an impeller roller 15 rotatable about an axis parallel to the axis 12*a* aforementioned, of which the function is to pick up the layer of tobacco 3 from the carding roller 12 and project the constituent particles, in the direction denoted F1, down into a substantially vertical descent channel 16 delimited by two side walls 17 and 18 extending parallel one with another and with the axis 12*a* of the carding roller 12.

More exactly, the channel 16 is set transversely parallel to the axis 12*a* of the carding roller 12, extending a given distance beyond the end of this same roller 12 on the side nearer the vertical wall denoted 5, compassed transversely between two side walls 19 and 20 and divided internally into a first portion 21 and a second portion 22 by a partition wall 23.

The first portion 21 is placed so as to receive the shredded tobacco 9 from the carding roller 12, whilst the second portion 22 is intended to receive reclaimed tobacco denoted 24, of which the origin will be described in due course.

The bottom end of the channel 16 is positioned facing the periphery of a toothed take-up unit 25 comprising respective take-up means 26 and impeller means 27 combining one with another to transfer the shredded tobacco 9 and the reclaimed tobacco 24 away from the channel 16.

The tobacco 9 and 24 is projected by the take-up unit 25 in the form of distinct particles onto a transfer belt 28 moving from right to left as seen in FIG. 1, and angled upward with the runout end located beneath the inlet of an ascent channel 29 of which the top outlet end 30 is enclosed by an aspirating belt 31 made of air-permeable material.

Thus, the particles of shredded tobacco 9 and reclaimed tobacco 24 are directed up through the ascent channel 29 in the direction indicated by the arrow denoted F2, forming a continuous flow carried on an air current generated by pneumatic means of conventional type (not illustrated); on reaching the top of the channel, the particles cling to the aspirating belt 31 and are gathered progressively into a continuous stream 32 of tobacco filler.

The stream 32 of tobacco forming externally of the ascent channel 29 is directed by the aspirating belt 31 toward a trimming station 33 at which its thickness is reduced to a predetermined and uniform value by relative trimming discs 34.

Thereafter, the trimmed stream 32 of tobacco is released by the aspirating belt 31 to the entry point of a station (not illustrated) where it is formed into a continuous cigarette rod.

It will be seen that the cigarette maker shown in the example of FIG. 1 has twin forming lines and is therefore equipped with two aspirating belts 31 placed side by side, and two trimming stations 33; reference is made in the specification to just one such line, the two being identical.

As discernible from FIG. 1, tobacco 24 removed from the stream 32 at the trimming station 33 by the trimming discs 34 is recovered and returned to the second portion 22 of the descent channel 16 through the agency of respective conveyor means 36 comprising a first conveyor belt 37, and a second conveyor 38 of which the outfeed end is positioned above the inlet of the second portion 22.

Figure 2:
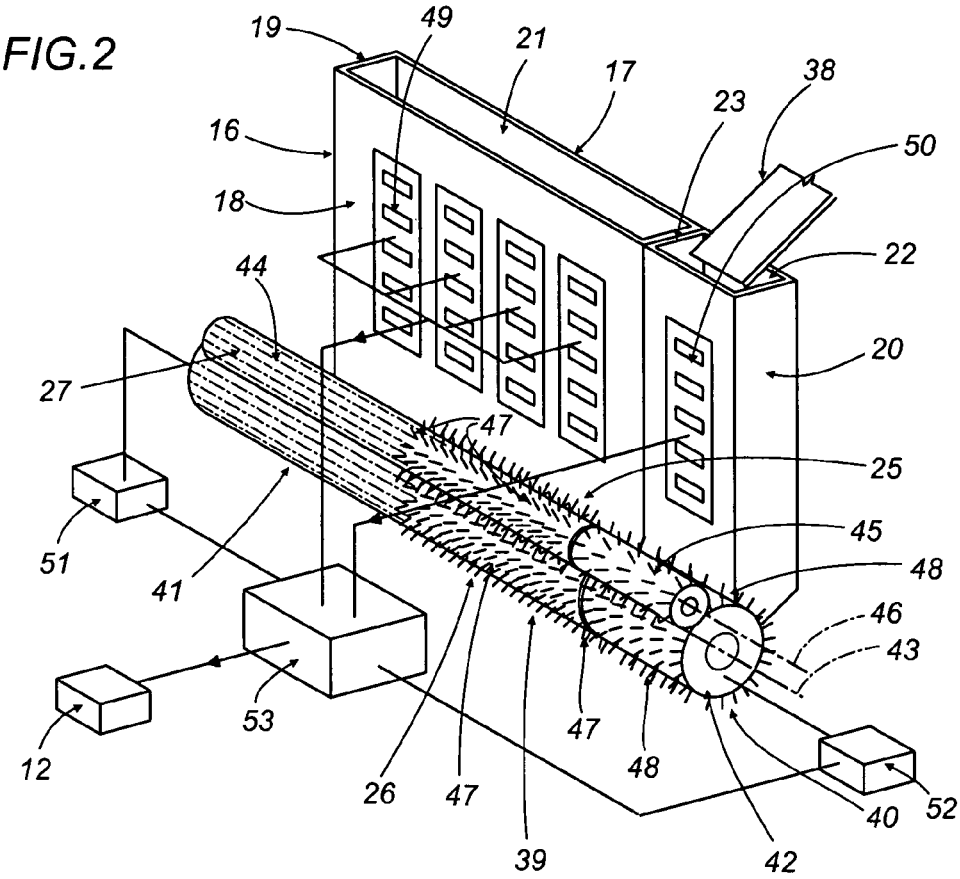
FIGS. 2 and 3 illustrate an enlarged detail of FIG. 1, viewed in perspective and shown in two different embodiments.

With reference to FIG. 1 and to the enlarged detail of FIG. 2, the toothed take-up unit 25 is divided into two independent sections denoted 39 and 40 placed respectively to handle the shredded tobacco 9 issuing from the first portion 21 of the channel 16 and the reclaimed tobacco 24 issuing from the second portion 22.

The take-up means 26 consist in a first toothed roller 41 and a second toothed roller 42 aligned on a common axis 43 parallel to the axis 21*a* of the carding roller 12 and positioned respectively at the outlets of the first portion 21 and the second portion 22 of the descent channel 16.

The impeller means 27 consist in a third toothed roller 44 and a fourth toothed roller 45 aligned on a common axis 46 parallel to the axis 43 mentioned above, rotatable tangentially to and operating in conjunction respectively with the first roller 41 and the second roller 42.

Accordingly, it will be apparent that the first roller 41 and the third roller 44 combine to create the first section 39 aforementioned, whilst the second roller 42 and the fourth roller 45 combine to create the second section 40.

Importantly, since the tobacco particles being handled are of different sizes, the distribution and/or the geometry of the teeth 47 presented by the rollers 41 and 44 of the one section will be dissimilar to the distribution and/or geometry of the teeth 48 presented by the rollers 42 and 45 of the other section. In particular, the axial and circumferential spacing of the teeth denoted 48, hence their concentration, is selected according to the nature of the reclaimed tobacco 24 with the aim of achieving a suitable compromise between delicate handling and a uniform flight of the tobacco 24 off the roller. Preferably, the teeth denoted 48 are spaced farther apart than the teeth denoted 47.

49 and 50 denote first and second sensing means mounted to the wall 18 of the descent channel 16, serving to monitor the levels of shredded tobacco 9 and reclaimed tobacco 24 respectively in the first portion 21 and in the second portion 22.

The first roller 41 and the second roller 42 of the take-up means 26 are associated with drive motors indicated schematically by blocks denoted 51 and 52, and means (not illustrated) by which drive is transmitted between the one set of rollers 41 and 44 and the other 42 and 45. Bearing in mind the configuration of the two sections 39 and 40, the two motors 51 and 52 are independent in operation, allowing the one set of rollers 41 and 44 to be rotated at a speed different to that of the other set of rollers 42 and 45.

Figure 3:
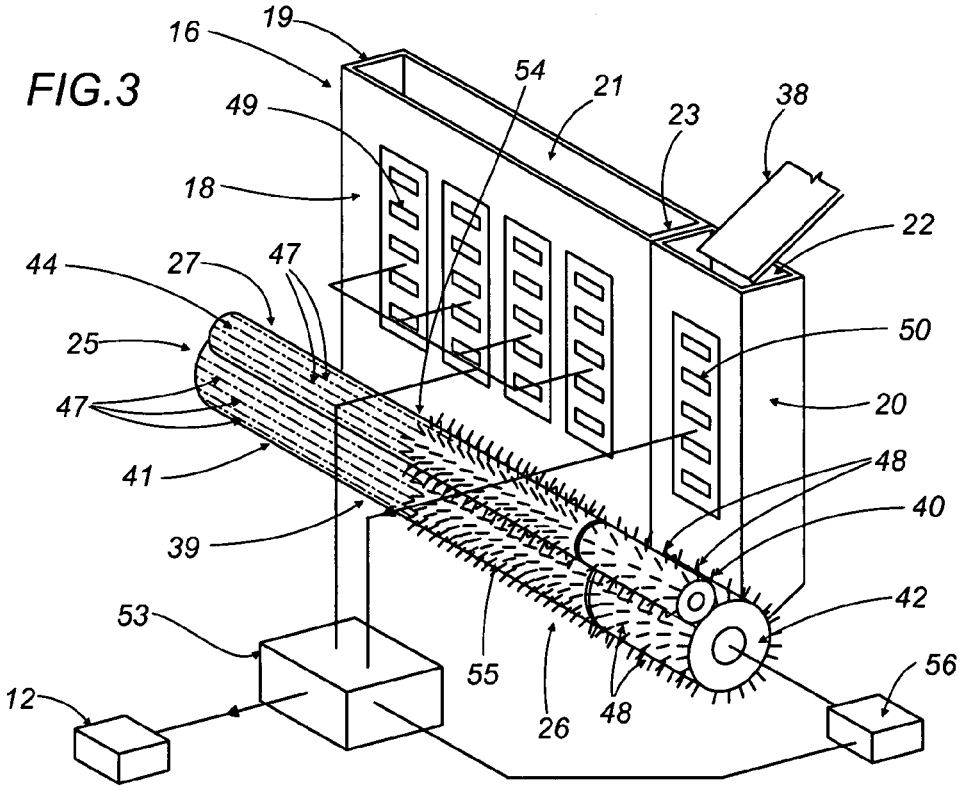

The machine 1 also comprises a master controller denoted 53 serving to pilot the operation of the drive motors 51 and 52 and the carding unit 13 (of which the carding roller 12 is shown schematically as a block in FIGS. 2 and 3), and connected on the input side to the sensing means 49 and 50 monitoring the level of the tobacco 9 and 24.

More exactly, the sensors denoted 49 govern the throughput of the carding roller 12 by controlling the relative drive means and thus determining the speed at which the roller turns on its axis 12*a*, whilst the sensors denoted 50 determine the speed of the take-up rollers 41 and 42 by controlling the relative motor 52.

In the example of FIG. 3, the take-up means 26 are embodied as in FIG. 2, whilst the impeller means 27 of the toothed unit 25 consist in a single roller denoted 55.

In accordance with the foregoing description and as illustrated in the accompanying drawings, the two types of tobacco, that is to say the shredded tobacco 9 and the reclaimed tobacco 24, are made to follow different paths and handled dissimilarly by the toothed unit 25 during the course of the cycle in which the stream 32 of tobacco filler is formed.

More precisely, the tobacco 24 recovered from the trimming station is not able to mix internally of the descent channel 16 with the shredded tobacco 9, being separated by the partition wall 23 and fed directly into the second portion 22 of the channel.

Also, it will be seen that after passing through the dedicated section 40 of the toothed unit 25, the reclaimed tobacco 24 is caused to advance along the transfer belt 28 and up the ascent channel 29 toward the aspirating belt 31, following a path independent of and distinct from that followed by the shredded tobacco 9.

Finally, it will be noted that the path followed by the reclaimed tobacco 24 terminates at a point coinciding with the upstream end of the aspirating belt 31; consequently, this tobacco remains beneath the newly shredded tobacco as the stream is formed progressively on the advancing belt and will not be exposed to the trimming action a second time.

What is claimed is:

1. A cigarette maker comprising:

a descent channel, presenting a first portion and a second portion distinct one from the other and serving respectively to admit shredded tobacco and reclaimed tobacco;

a carding unit by which shredded tobacco is fed into the descent channel;

conveyor means by which reclaimed tobacco is fed into the descent channel;

a toothed take-up unit comprising a first section and a second section by which the shredded tobacco and the reclaimed tobacco are taken up from the respective outlet ends of the first and second portions of the descent channel and directed toward an ascent channel through which the tobacco is carried as a flow of distinct particles;

an aspirating belt positioned at the outlet of the ascent channel, on which the flow of particles is formed into a stream and advanced toward a trimming station, thence to the entry point of a station at which the stream is formed into a continuous cigarette rod, wherein the toothed take-up unit comprises take-up means and impeller means operating in conjunction one with another, of which at least the take-up means incorporate a first toothed roller and second toothed roller embodied independently of one another, aligned on a common axis and positioned to coincide with the first section and the second section.

2. A machine as in claim 1, wherein the first and second sections of the toothed take-up unit are independent of one another.

3. A machine as in claim 2, wherein the impeller means consist in a single roller disposed substantially tangential to the first and second toothed rollers.

4. A machine as in claim 3, wherein the single impeller roller is a toothed roller and presents two portions of which the respective teeth are distributed dissimilarly.

5. A machine as in claim 4, wherein the teeth presented by the portion of the single impeller roller lying substantially tangential to the second roller are spaced farther apart than the teeth presented by the portion of the selfsame roller lying substantially tangential to the first roller.

6. A machine as in claim 3, comprising first means by which to detect the level of shredded tobacco occupying the first portion of the descent channel, and second means by which to detect the level of reclaimed tobacco occupying the second portion of the descent channel.

7. A unit as in claim 2, wherein the impeller means comprise a third roller and a fourth roller aligned on a common axis in positions substantially tangential to the first and second toothed rollers.

8. A machine as in claim 7, wherein the third and fourth rollers of the impeller means are toothed rollers of which the respective teeth are distributed dissimilarly, inasmuch as the teeth presented by the fourth roller are spaced farther apart than the teeth presented by the third roller.

9. A machine as in claim 7, comprising first means by which to detect the level of shredded tobacco occupying the first portion of the descent channel, and second means by which to detect the level of reclaimed tobacco occupying the second portion of the descent channel.

10. A machine as in claim 2, wherein the teeth of the first toothed roller and the teeth of the second toothed roller are distributed dissimilarly.

11. A machine as in claim 10, wherein the teeth presented by the second roller are spaced farther apart than the teeth presented by the first roller.

12. A machine as in claim 10, comprising first means by which to detect the level of shredded tobacco occupying the first portion of the descent channel, and second means by which to detect the level of reclaimed tobacco occupying the second portion of the descent channel.

13. A machine as in claim 2, wherein at least the first and second rollers are set in motion by respective drive means operating independently of one another.

14. A machine as in claim 2, comprising first means by which to detect the level of shredded tobacco occupying the first portion of the descent channel, and second means by which to detect the level of reclaimed tobacco occupying the second portion of the descent channel.

15. A machine as in claim 1, comprising first means by which to detect the level of shredded tobacco occupying the first portion of the descent channel, and second means by which to detect the level of reclaimed tobacco occupying the second portion of the descent channel.

16. A machine as in claim 15, comprising a master control unit connected on the input side to the first and second means serving to detect the respective levels of shredded tobacco and reclaimed tobacco, and on the output side to the carding unit and the take-up means.

17. A cigarette maker as in claim 1, wherein the machine is of a type equipped with one processing line.

18. A cigarette maker as in claim 1, wherein the machine is of a type equipped with twin processing lines.

* * * * *